US008220391B2

(12) United States Patent
Hirokawa et al.

(10) Patent No.: US 8,220,391 B2
(45) Date of Patent: Jul. 17, 2012

(54) PRINTING METHOD FOR PRINTING PRESS AND PRINTING PRESS

(75) Inventors: Katsushi Hirokawa, Fuchu (JP); Takashi Kimura, Fuchu (JP); Hideki Ikeda, Fuchu (JP); Tsuyoshi Inui, Kadoma (JP)

(73) Assignee: Ryobi Ltd., Hiroshima-Ken (JP)

( * ) Notice: Subject to any disclaimer, the term of this patent is extended or adjusted under 35 U.S.C. 154(b) by 705 days.

(21) Appl. No.: 12/366,626

(22) Filed: Feb. 5, 2009

(65) Prior Publication Data

US 2009/0195627 A1 Aug. 6, 2009

(30) Foreign Application Priority Data

Feb. 6, 2008 (JP) ..... 2008-026311
Oct. 27, 2008 (JP) ..... 2008-275488

(51) Int. Cl.
*B41L 35/14* (2006.01)

(52) U.S. Cl. ..... 101/488; 101/424.1

(58) Field of Classification Search ..... 101/488
See application file for complete search history.

(56) References Cited

U.S. PATENT DOCUMENTS

| | | | | |
|---|---|---|---|---|
| 6,350,071 | B1 * | 2/2002 | Conwell et al. | 400/118.2 |
| 6,852,948 | B1 * | 2/2005 | Harrison | 219/121.85 |
| 6,857,368 | B2 * | 2/2005 | Pitz | 101/484 |
| 7,249,835 | B2 * | 7/2007 | Hoshino et al. | 347/102 |
| 7,433,627 | B2 * | 10/2008 | German et al. | 399/102 |
| 7,887,175 | B2 * | 2/2011 | Mogi et al. | 347/102 |
| 2004/0189728 | A1 * | 9/2004 | Nakajima | 347/14 |
| 2005/0235851 | A1 | 10/2005 | Beier et al. | |
| 2006/0007290 | A1 | 1/2006 | Oshima et al. | |
| 2006/0119686 | A1 | 6/2006 | Odell | |
| 2007/0206083 | A1 | 9/2007 | Hoshino | |

FOREIGN PATENT DOCUMENTS

| | | | |
|---|---|---|---|
| DE | 10 2004 020 454 | A1 | 11/2005 |
| DE | 10 2007 040 139 | A1 | 4/2008 |
| EP | 1 439 071 | B1 | 9/2007 |
| EP | 1 599 340 | B1 | 9/2007 |
| JP | 2167748 | A | 6/1990 |
| JP | 2229045 | A | 9/1990 |
| JP | 2005-238562 | | 9/2005 |
| JP | 2006-297690 | | 11/2006 |
| JP | 2008-207369 | | 9/2008 |
| JP | 2008-307891 | | 12/2008 |
| JP | 2009137302 | A | 6/2009 |

OTHER PUBLICATIONS

Office Action for Chinese Patent Application No. 200910006912.9 with English translation.

(Continued)

*Primary Examiner* — Anthony Nguyen
(74) *Attorney, Agent, or Firm* — TIPS Group

(57) ABSTRACT

There are provided a printing method for a printing press that includes: printing an image on a sheet of paper fed using an ultraviolet curable paint; and irradiating the ultraviolet curable paint on the printed sheet fed by selectively causing a plurality of light emitting diodes disposed at predetermined intervals across a lateral direction of the sheet to turn on in accordance with the location and size of a predetermined area of the sheet, thereby irradiating the predetermined area with ultraviolet light therefrom and curing the predetermined area.

8 Claims, 9 Drawing Sheets

OTHER PUBLICATIONS

German Patent and Trademark Office Examination Report dated Jun. 10, 2009 for corresponding German Patent Application, File Ref. 102009007873.8-37.

Notification of Reasons for Refusal, Patent Application No. 2008-275488, Drafting Date: Oct. 22, 2009; Attorney: Noboru Fujimoto, Esq.; Applied Provision of the Patent Law: Section 29(2), Section 29-2.

* cited by examiner

PRINTING METHOD FOR PRINTING PRESS AND PRINTING PRESS

CROSS REFERENCE TO RELATED APPLICATION

This application claims priority from Japanese Patent Application Nos. 2008-26311 and 2008-275488, which are incorporated herein by reference.

BACKGROUND OF THE INVENTION

1. Field of the Invention

The present invention relates to a printing method for a printing press and a printing press, the method involving printing images on sheets of paper fed using ultraviolet curable paints, and irradiating the ultraviolet curable paints on the printed sheets fed with ultraviolet light from light emitting diodes so as to cure the paints. The "paints" as used herein include inks as well as varnishes for use in surface protection and gloss finishing of ink-printed materials.

2. Related Art

Printing presses that perform printing with ultraviolet curable inks have been used heretofore, and for curing the ultraviolet curable inks on the sheets of paper by mean of ultraviolet irradiation, there is proposed a printing press including a single ultraviolet lamp (e.g., a mercury lamp or a xenon lamp) of a size slightly longer than the width of a sheet-conveying cylinder (e.g., see Japanese Patent No. 2006-297690 (FIG. 5)).

The printing press sometimes performs printing on a sheet of a smaller width than the cylinder. As shown in FIG. 9, in order to cure the ultraviolet curable inks on a sheet P of a smaller width than a cylinder 3 while the sheet P is being conveyed, ultraviolet light is applied thereto from an ultraviolet lamp 200 located above the cylinder 3; in this case, the ultraviolet light is thrown also on exposed surfaces 3A and 3B on both lateral ends at the right and left of the cylinder 3, which leads to corrosion of the metallic cylinder 3, deterioration of accuracy in registration of the sheet P due to thermal expansion of the cylinder 3, and in addition, cure of some ultraviolet ink misted over the exposed surfaces 3A and 3B of the cylinder 3 and adhered thereto as a result of ultraviolet irradiation.

And besides, the aforementioned lamp not only is short in service life but also generates much heat and consumes much power. For this reason, a printing press adopting light emitting diodes capable of ultraviolet radiation has been proposed recently (e.g., see Japanese Unexamined Patent Publication No. 2005-238562 (FIG. 1)).

Although the configuration as disclosed in Japanese Unexamined Patent Publication No. 2005-238562 is advantageous in terms of service life, heat generation, and power consumption, the configuration still involves a problem as described above of corrosion of exposed portions in the case of applying ultraviolet light to a sheet of paper of a smaller width than a cylinder, which calls for further improvement.

SUMMARY OF THE INVENTION

The present invention has been conceived in view of the foregoing problems, and it is an object of the present invention to provide a printing method for a printing press and a printing press that are capable of providing advantages in terms of service life, heat generation, and power consumption while overcoming various problems caused by ultraviolet irradiation.

According to one aspect of the present invention, there is provided a printing method for a printing press that includes: printing an image on a sheet of paper fed using an ultraviolet curable paint; and irradiating the ultraviolet curable paint on the printed sheet fed by selectively causing a plurality of light emitting diodes disposed at predetermined intervals across a lateral direction of the sheet to turn on in accordance with the location and size of a predetermined area of the sheet, thereby irradiating the predetermined area with ultraviolet light therefrom and curing the predetermined area.

According to another aspect of the present invention, there is provided a printing press that includes: a printer section for printing an image on a sheet of paper fed using an ultraviolet curable paint; an ultraviolet irradiator section for curing the ultraviolet curable paint on the printed sheet fed, the ultraviolet irradiator section including a plurality of light emitting diodes arranged at predetermined intervals across a lateral direction of the sheet; an irradiation area calculating part that calculates an ultraviolet irradiation area based on the location and size of a predetermined area of the sheet for the predetermined area to be irradiated with ultraviolet light; and a lighting controlling part that selectively causes the light emitting diodes to turn on in such manner as to irradiate the irradiation area calculated at the irradiation area calculating part with ultraviolet light.

The light emitting diodes are selectively caused to turn on in such a manner as to irradiate a predetermined area of a sheet with ultraviolet light based on the location and size of the predetermined area, so that the light emitting diodes corresponding in position to a portion other than the sheet are not turned on and therefore the portion other than the sheet is not substantially irradiated with ultraviolet light. Since the position of a sheet to be printed is adjusted in a right-to-left direction and in a sheet conveying direction before being subjected to printing and the sheet is transferred to a downstream process while being kept at the adjusted position, the positioning information of the sheet is not required, and the on-control of the light emitting diodes is possible only with the information on the size of the sheet.

The predetermined area may be any one of the entire area of the sheet, an area of an image printed on the sheet, and a portion of the area of the image.

The light emitting diodes may be controlled such that only the light emitting diodes for irradiating a sheet passing area on the path of the sheet are turned on, while the residual light emitting diodes for irradiating an area other than the sheet passing area are turned off.

The sheet to pass through the sheet passing area may be divided into a plurality of areas in the lateral direction, determination may be made as to whether or not each divided area contains an image, the light emitting diodes may be controlled such that a light emitting diode for irradiating the area containing an image is turned on, and that a light emitting diode for irradiating the area not containing an image is turned off.

A plurality of substrates may be provided to each mount a plurality of light emitting diodes, so that the light emitting diodes may be on/off-controlled on a substrate-by-substrate basis.

The light emitting diodes may be turned on as soon as or immediately before a leading end of the sheet in a conveying direction locates at an irradiation area of the light emitting diodes, and the turned-on light emitting diodes may be turned off when a trailing end of the sheet in the conveying direction is out of the irradiation area of the light emitting diodes.

The light emitting diodes may be turned on as soon as or immediately before a leading end of an image printed on the sheet in a conveying direction locates at an irradiation area of the light emitting diodes, and the turned-on light emitting diodes may be turned off when a trailing end of the image in the conveying direction is out of the irradiation area of the light emitting diodes.

In printing on the sheet a plurality of images with a space interposed therebetween in the conveying direction, determination may be made as to whether or not the space is equal to or larger than a predetermined distance, and when the space is determined as being equal to or larger than the predetermined distance, the light emitting diodes may be turned off when a trailing end of an image on an upstream side in the conveying direction passes through an irradiation area of the light emitting diodes, and the turned-off light emitting diodes may be switched on as soon as or immediately before a leading end of an image on a downstream side in the conveying direction locates at the irradiation area of the light emitting diodes.

In on/off-controlling light emitting diodes according to the above third to fifth aspects, the light emitting diodes may be turned on as soon as or immediately before a leading end of the sheet or an image printed on the sheet in a conveying direction locates at an irradiation area of the light emitting diodes, and the turned-on light emitting diodes may be turned off when a trailing end of the sheet or the image printed on the sheet in the conveying direction is out of the irradiation area of the light emitting diodes.

Since the light emitting diodes are not turned on for a portion other than the sheet and ultraviolet light will not be applied thereto by controlling the light emitting diodes to turn on so as to irradiate a predetermined area of the sheet with ultraviolet light in accordance with the location and size of the area, it is possible to provide a printing method for a printing press and the printing press that are advantageous in terms of service life, heat generation, and power consumption while being capable of overcoming various problems caused by ultraviolet irradiation including corrosion of cylinders, deterioration of accuracy in registration due to thermal expansion of the cylinders, and adhesion of ultraviolet curable paints.

The sheet of paper to pass through a sheet passing area is divided into a plurality of areas in the lateral direction, determination is made as to whether or not each of the divided areas contains an image, and a light emitting diode for irradiating the area containing an image is turned on, while a light emitting diode for irradiating the area not containing an image is turned off; advantages are available from this configuration in terms of heat generation and power consumption as compared with the case of turning the light emitting diodes on over the entire lateral areas of the sheet.

A plurality of substrates each including a plurality of light emitting diodes are provided and the light emitting diodes are on/off-controlled on a substrate-by-substrate basis. In this manner, the configuration can be simplified as compared with a configuration in which each light emitting diode is on/off-controlled individually.

The light emitting diodes are controlled such that the light emitting diodes are turned on as soon as or immediately before the leading end of the sheet in the conveying direction locates at an irradiation area of the light emitting diodes and that the turned-on light emitting diodes are turned off when the trailing end of the sheet in the conveying direction is out of the irradiation area of the light emitting diodes. Advantages are available from this configuration in terms of heat generation and power consumption as compared with a configuration in which light emitting diodes are kept on at all times from the start of printing.

The light emitting diodes are controlled such that the light emitting diodes are turned on as soon as or immediately before the leading end of an image printed on the sheet in the conveying direction locates at an irradiation area of the light emitting diodes and that the turned-on light emitting diodes are turned off when the trailing end of the image in the conveying direction is out of the irradiation area of the light emitting diodes. Advantages are available from this configuration in terms of heat generation and power consumption as compared with a configuration in which light emitting diodes are turned on for each sheet of paper.

In the case where a plurality of images are printed on the sheet with a space interposed in the conveying direction, determination is made as to whether or not the space is equal to or larger than a predetermined distance, and when the space is determined as being equal to or larger than the predetermined distance, the light emitting diodes are turned off when the trailing end of an image on the upstream side in the conveying direction passes through an irradiation area of the light emitting diodes, and the turned-off light emitting diodes are switched on as soon as or immediately before the leading end of an image on the downstream side in the conveying direction locates at the irradiation area of the light emitting diodes; advantages are available from this configuration in terms of heat generation and power consumption as compared with a configuration in which light emitting diodes are kept on without being switched by images. In addition, in the case of the space being less than the predetermined distance, the light emitting diodes are kept on, so that it is possible to avoid delay in timing to turn on the light emitting diodes which have been turned off for an image on the upstream side, at the leading end of an image on the downstream side, thus preventing occurrence of a portion where the paint is immaturely cured.

In on/off-controlling the light emitting diodes according to the third to fifth aspects, the light emitting diodes are turned on as soon as or immediately before the leading end of the sheet or of an image printed on the sheet in the conveying direction locates at an irradiation area of the light emitting diodes, and the turned-on light emitting diodes are turned off when the trailing end of the sheet or of the image printed on the sheet in the conveying direction is out of the irradiation area of the light; emitting diodes. In this manner, the light emitting diodes can be on/off-controlled also in the conveying direction in addition to the lateral direction to the right and left of the sheet, and further advantages are provided from this configuration in terms of heat generation and power consumption as compared with a configuration in which on/off-control of light emitting diodes is performed in only one direction (either the right-to-left lateral direction or the conveying direction).

DESCRIPTION OF THE PREFERRED EMBODIMENTS

Figure 1:
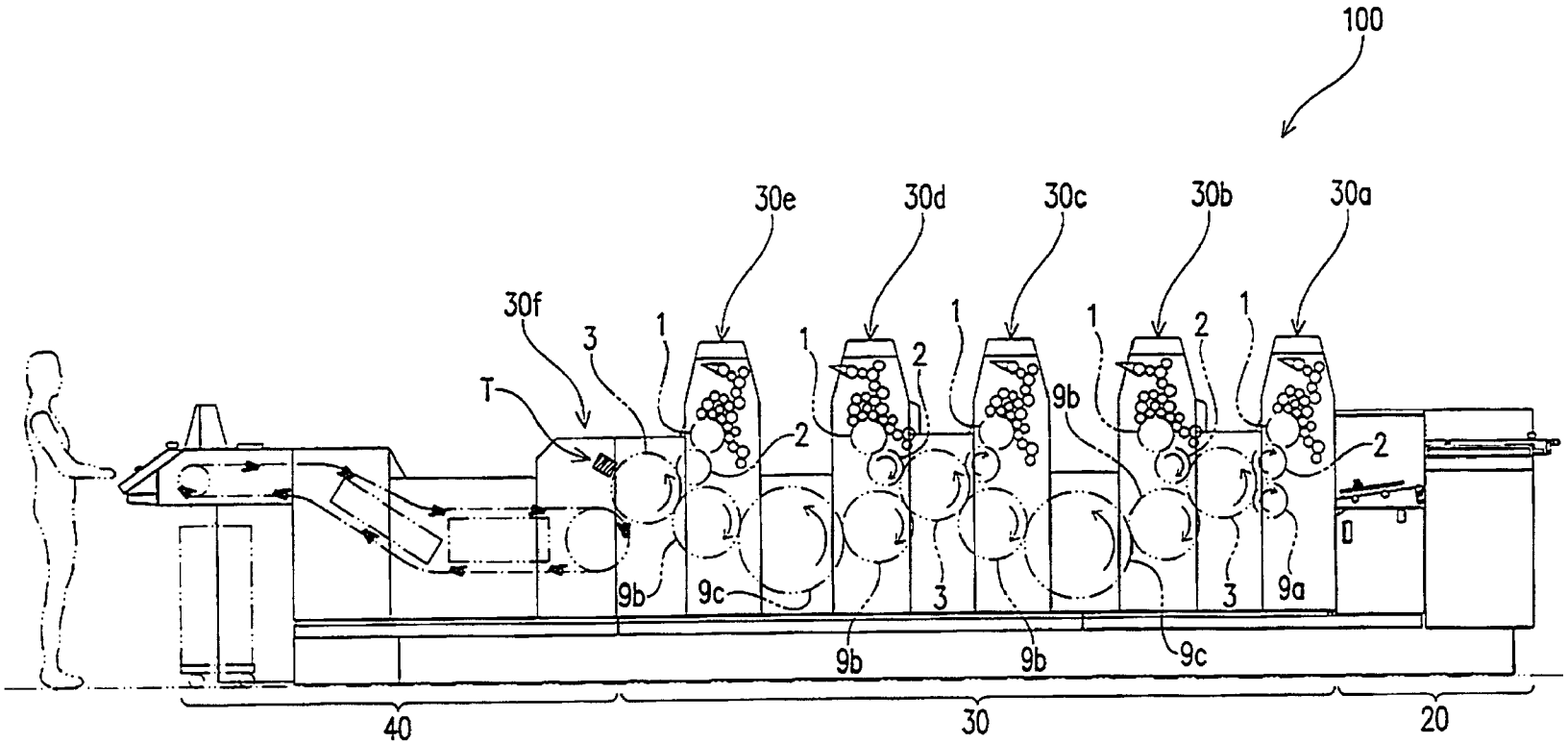
FIG. 1 is a side view showing an exemplary schematic configuration of a printing press for implementing a printing method for a printing press according to the present invention.

Embodiments of the present invention are described below with reference to the drawings. FIG. 1 shows an exemplary schematic configuration of a printing press 100 for implementing a printing method for a printing press according to the present invention. The printing press includes a control section S shown in FIG. 2 to be described later.

As shown in FIG. 1, the printing press 100 is adapted to perform printing in five colors with inks of four basic colors that are different from one another, i.e., cyan (C), magenta (M), yellow (Y), and black (Bk), in addition to a special color, e.g., gold, silver, a fluorescent color, or a pearlized color for special color printing or complementary color printing. The printing press 100 includes a sheet feeder section 20, a printer section 30, and a sheet discharge section 40. The sheet feeder section 20 is capable of feeding sheets of paper (not shown) into the printer section 30. The printer section 30 is capable of performing printing on the sheets fed from the sheet feeder section 20 and includes a plurality of printing units (five printing units 30*a* to 30*e* that create basic color images in C, M, Y, and Bk and a special color image through special color printing or complementary color printing, respectively). The sheet discharge section 40 is capable of discharging the sheets that have been printed in the printer section 30 into a stack of sheets along a vertical direction.

Ultraviolet curable inks (hereinafter simply referred to as inks) are used as the inks, and a drying unit 30*f* is coupled to the rear end of the printing unit 30*e* located at the terminal end for curing the inks on the printed sheets that have been passed through the printing units 30*a* to 30*e*.

In the printing press 100, sheets are fed from the sheet feeder section 20 into the printer section 30, are printed at the printing units 30*a* to 30*e* in the printer section 30, and are then provided to the drying unit 30*f* for cure of the inks, so as to be discharged at the sheet discharge section 40. Before sheets are fed from the sheet feeder section 20 into the printer section 30, the sheets are located (registered) at a predetermined position along the conveying direction and the right-to-left lateral direction. After the registration, the sheets are conveyed to the sheet discharge section 40 while being held in the registered state.

The printing units 30*a* to 30*e* of the printer section 30 each include a plate cylinder 1, a rubber cylinder 2, and an impression cylinder 3 as a set of main components. The printing unit 30*a* includes a transfer cylinder 9*a*, and the printing units 30*b* to 30*d* include transfer cylinders 9*b* and 90*c*, which transfer cylinders all have different sizes. These transfer cylinders and the impression cylinders 3 are provided with grippers (not shown) for holding and conveying the sheets and transferring the sheets to an adjacent cylinder in the conveying direction in a cooperative manner.

Printing plates are arranged on the respective plate cylinders 1 in the printing units 30*a* to 30*e*. An ink and water are supplied to each plate, and the ink is transferred onto a rubber cylinder 2 following the plate. Then, the ink transferred on the rubber cylinder 2 is further transferred onto an upcoming sheet while being held between the rubber cylinder 2 and an impression cylinder 3 opposing the rubber cylinder 2. In this manner, printing can be performed sequentially on the sheets fed from the sheet feeder section 20 based on the respective plates arranged on the five plate cylinders 1.

Provided inside the drying unit 30*f* is an ultraviolet irradiator section T for irradiating the inks on the printed sheets conveyed thereto with ultraviolet light to cure the inks.

Figure 3A:
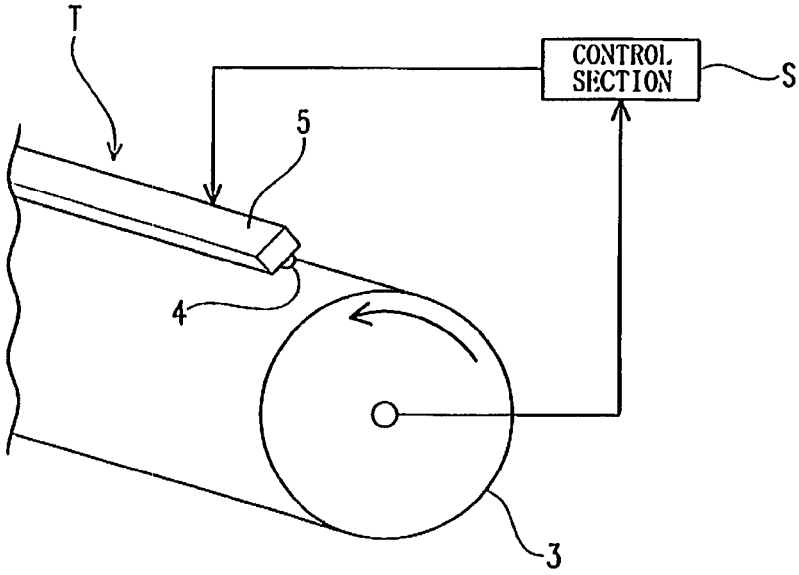
FIG. 3A is a perspective view showing a positional relationship in arrangement between an impression cylinder and light emitting diodes.
Figure 3B:
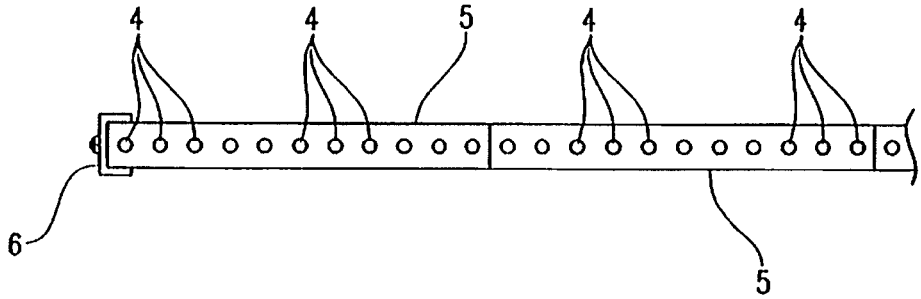
FIG. 3B is a front view of a substrate including the light emitting diodes.

As also shown in FIGS. 3A and 3B, the ultraviolet irradiator section T includes forty-four light emitting diodes (hereinafter referred to as LEDs) 4 that have an irradiation axis along a direction substantially orthogonal to the surface of the impression cylinder 3, the LEDs 4 being disposed above the impression cylinder 3. It is preferred that the LEDs 4 be disposed as closely as possible relative to the impression cylinder 3 in terms of cure efficiency but be disposed so as not to touch the incoming sheets P.

The forty-four LEDs 4 are arranged at predetermined (equal) intervals in a straight line along the lateral direction of sheets (the impression cylinder 3) so that ultraviolet light can be irradiated over the entire lateral area of the impression cylinder 3.

Eleven of the forty-four LEDs 4 are each included in a transversally elongate substrate 5, and a total of four substrates 5 are serially coupled to each other in the lateral direction of the sheets (the impression cylinder 3). Supports 6 (only one of which is shown in FIG. 3B) are fixed to the ends of both the outermost substrates 5, such that the four substrates 5 are supported with the right and left supports 6 at a predetermined distance (a predetermined height) from the surface of the impression cylinder 3.

As shown in FIG. 3A, on/off-control of the LEDs 4 is performed through the control section S in such a manner that the location of a sheet or an image printed on a sheet relative to the impression cylinder 3 is found based on information from a detecting part (specifically, a rotary encoder) that detects the angle of rotation of the impression cylinder 3. The location of a sheet relative to the impression cylinder 3 or an image relative to a sheet can be found from data calculated based on pre-press data; the data is inputted to the control section S in advance, and the coincidence of the data with the detected information from the detecting part indicates the location of the sheet relative to the impression cylinder 3 or the location of the image relative to the sheet.

Figure 2:
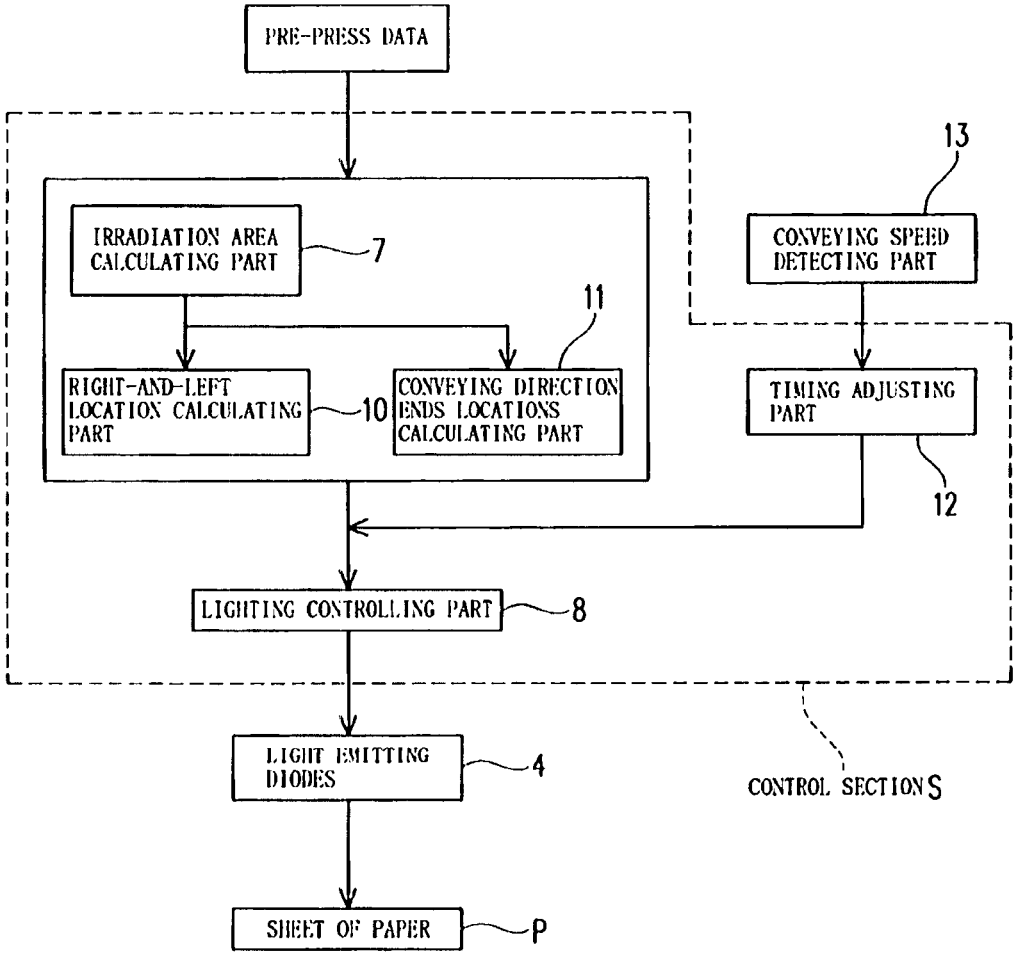
FIG. 2 is a block diagram of the configuration of a control section.

More specifically, as shown in FIG. 2, the control section S basically includes an irradiation area calculating part 7 and a lighting controlling part 8. The irradiation area calculating part 7 calculates an ultraviolet irradiation area based on the size of a sheet or the location and size of an image printed on a sheet. The lighting controlling part 8 selectively causes the LEDs 4 to turn on so as to irradiate with ultraviolet light the irradiation area calculated at the irradiation area calculating part 7.

The irradiation area calculating part 7 is configured to calculate an irradiation area based on the pre-press data inputted to the control section S, the pre-press data having been prepared during a process of laying out an image to create a plate at a pre-printing stage. More specifically, the irradiation area calculating part 7 includes a right-and-left location calculating part 10 and a conveying direction ends locations calculating part 11 so as to selectively cause the LEDs 4 to turn on based on the calculated locations, wherein the right-and-left location calculating part 10 calculates the locations of both ends on the right and left in the lateral direction of a sheet using the pre-press data, and the conveying direction ends locations calculating part 11 calculates the locations of a leading end and of a trailing end in the conveying direction of a sheet or an image printed on a sheet.

Figure 4A:
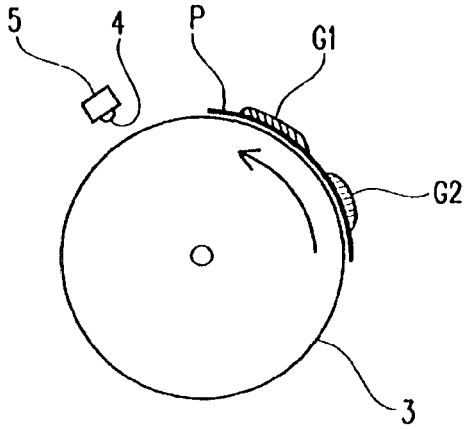
FIG. 4A is a side view showing a positional relationship in arrangement between a sheet of paper and the light the emitting diodes.
Figure 4B:
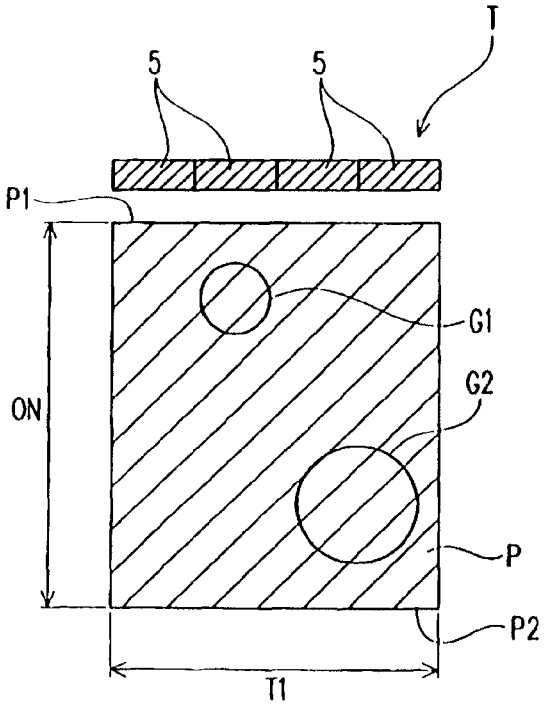
FIG. 4B is a plan view of a first example showing an irradiation area on a sheet of paper.

For instance, a sheet passing area on the path of a sheet and a non-sheet passing area that is not on the path of the sheet can be known based on the information on the right and left locations from the right-and-left location calculating part 10. FIG. 4A shows a state in which a printed sheet P with two, large and small images G1 and G2 created thereon is being conveyed. FIG. 4B shows a case in which LEDs 4 for irradiating a sheet passing area T1 on the path of the sheet P are turned oil (in the Figure, all the four substrates 5 are turned on) and no LED 4 is turned off, as there is no non-sheet passing area that is not on the path of the sheet P.

Figure 4C:
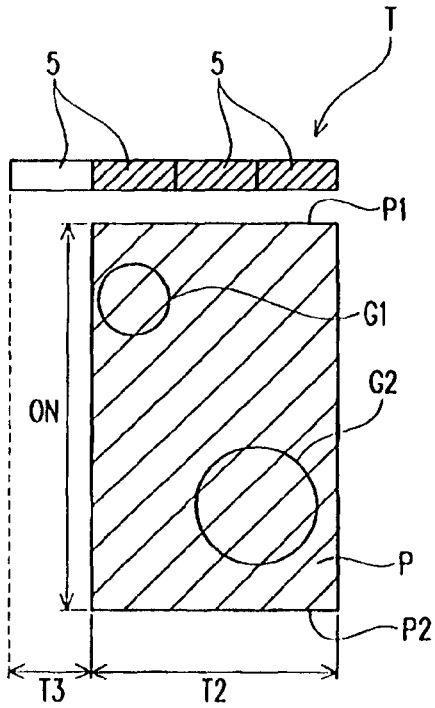
FIG. 4C is a plan view of a second example showing an irradiation area on a sheet of paper.

In FIG. 4C, LEDs 4 for irradiating a sheet passing area T2 on the path of the sheet P are turned on (in the Figure, three of the four substrates 5 are turned on), and LEDs 4 for irradiating a non-sheet passing area T3 that is not on the path of the sheet P are turned off (in the Figure, a substrate 5 at the left end is turned off). Thus, the LEDs 4 for irradiating the non-sheet passing area T3 are turned off, so that ultraviolet light is not irradiated to an exposed portion in the non-sheet passing area T3 of the surface of the impression cylinder 3, thereby preventing a problem caused by ultraviolet irradiation.

Although FIGS. 4A and 4B show a case in which the LEDs 4 are on/off-controlled based on the width of the sheet P, the control section S is so configured as to perform on/off-control of the LEDs 4 at a further precise level by on/off-controlling the LEDs 4 based on the presence or absence of an image in the lateral direction in addition to the size of the sheet P.

Figure 5A:
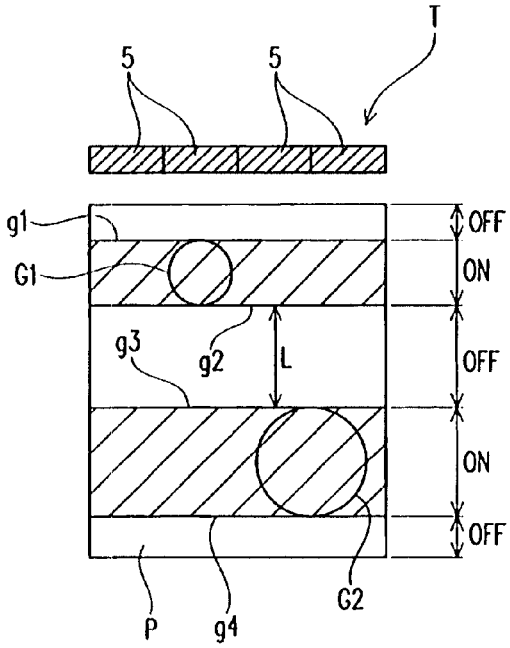
FIG. 5A is a plan view of a third example showing an irradiation area on a sheet of paper.
Figure 5B:
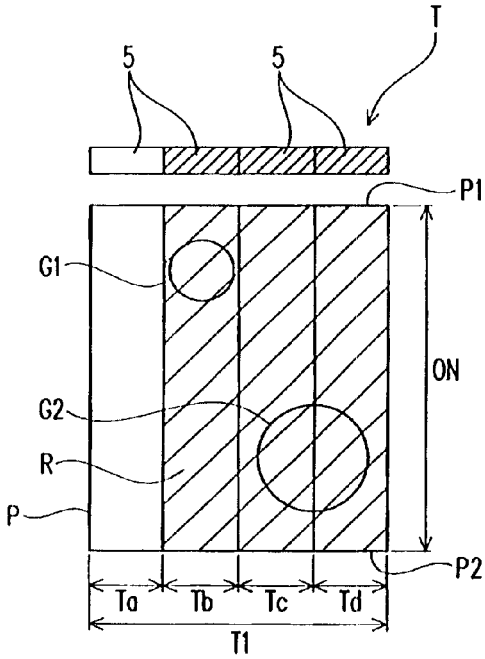
FIG. 5B is a plan view of a fourth example showing an irradiation area on a sheet of paper.

That is, as shown in FIG. 5B, the sheet P to pass through the sheet passing area T1 is divided into a plurality of areas Ta to Td in the lateral direction, and each of the divided areas Ta to Td is subjected to determination as to whether or not the area contains an image based on the pre-press data (which means configuring an image determining part). If an image is contained, LEDs 4 (in the Figure, the LEDs 4 in the three substrates 5) for irradiating the corresponding areas Tb, Tc, and Td (in the Figure, the three areas on the right) are turned on, whereas if an image is not contained, LEDs 4 for irradiating the corresponding area Ta (in the Figure, the LEDs 4 in the one substrate 5 at the left end) are turned off (which means configuring an area-based lighting controlling part), hence providing a configuration beneficial in terms of heat generation and power consumption in comparison with a configuration for irradiating the entire sheet P.

A description is given next on a configuration for on/off-controlling the LEDs 4 based on the result of calculation at the conveying direction ends locations calculating part 11.

A lighting controlling part for the lighting control relative to the conveying direction of the sheet P is configured to perform control in such a way that, based on the information of the locations of both ends in the conveying direction from the conveying direction ends locations calculating part 11, namely, the location information of the sheet P in the conveying direction obtained from the rotary encoder, the LEDs 4 are turned on as soon as or immediately before a leading end P1 in the conveying direction of the sheet P (see FIGS. 4B and 4C) is located at the irradiation area of the LEDs 4 and the turned-on LEDs are turned off when a trailing end P2 in the conveying direction of the sheet P (see FIGS. 4B and 4C) is brought out of the irradiation area of the LEDs 4. In other words, the areas of the sheet P lying along the conveying direction shaded with the oblique lines in FIGS. 4B and 4C indicate the time span over which the LEDs 4 are turned on, which means the LEDs 4 are turned off for a portion where the sheet P does not exist, thus providing a configuration that is beneficial in terms of heat generation and power consumption in comparison with a configuration in which the LEDs 4 are kept turned on at all times in the conveying direction.

As shown in FIG. 5A, instead of controlling the LEDs 4 to turn on based on the positions of the leading and trailing ends in the conveying direction of the sheet P, it is possible to perform the control in such a way as to turn on the LEDs 4 (in the Figure, the LEDs 4 in all the substrates 5) as soon as or immediately before the respective leading ends g1 and g3 in the conveying direction of the images G1 and G2 printed on the sheet P locate at the irradiation area of the LEDs 4 and to turn off the turned-on LEDs 4 (in the Figure, the LEDs 4 in all the substrates 5) when the respective trailing ends g2 and g4 in the conveying direction of the images G1 and G2 are brought out of the irradiation area of the LEDs 4 (this configures the lighting controlling part relative to the conveying direction of the images on the sheet P). In FIG. 5A, the ons and offs of the LEDs 4 are described on the right end of the sheet P. Such configuration enables curtailing of the on-periods of the LEDs 4 as compared with the case of irradiating the entire sheet P, thereby providing advantages in respect to heat generation and power consumption.

As shown in FIG. 5A, a further description is given on a case in which the plurality of images G1 and G2 (two in the Figure) are printed on the sheet P with a space interposed in the conveying direction. In the case of printing the two images G1 and G2, the on/off-control of the LEDs 4 is changed depending on the space between the images G1 and G2. That is, it is determined whether or not the space between the plurality of images G1 and G2 (two images in the Figure) is equal to or larger than a predetermined distance L based on the pre-press data (a predetermined distance determining part), and if the space is determined as being equal to or larger than the predetermined distance L, the LEDs 4 are turned off when the trailing end g2 of the image G1 at the upstream side in the conveying direction passes through the irradiation area of the LEDs 4, and the turned-off LEDs 4 are switched on as soon as or immediately before the leading end g3 of the image G2 at the downstream side in the conveying direction reaches the irradiation area of the LEDs 4 (an on/off switching part is configured in this manner).

The five kinds of control, i.e., the on/off-control of the LEDs 4 in the lateral direction of a sheet (referred to as lateral control A), the on/off-control of the LEDs 4 in the lateral direction of an image on a sheet (referred to as lateral control B), the on/off-control of the LEDs 4 in the conveying direction of a sheet (referred to as conveying direction control A), the on/off-control of the LEDs 4 in the conveying direction of an image on a sheet (referred to as conveying direction control B), and the on/off-control of the LEDs 4 corresponding to a space between a plurality of images on a sheet (referred to as conveying direction control C), may not only be employed independently by means of selection with a switch or the like (not shown) but also be used by combining two or more of the five kinds of control.

Figure 5C:
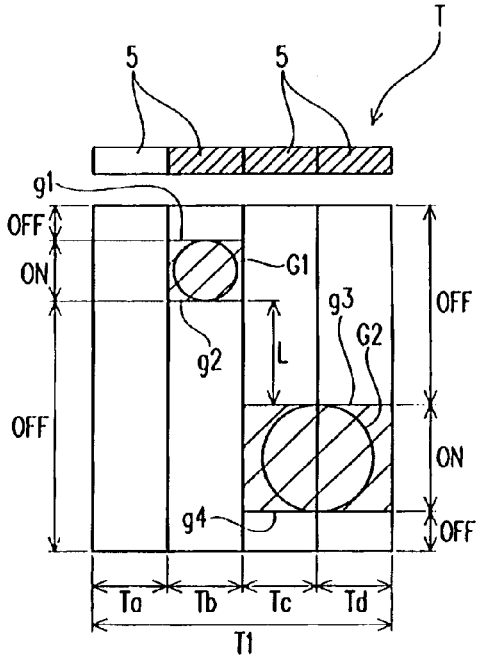
FIG. 5C is a plan view of a fifth example showing an irradiation area on a sheet of paper.

According to a specific example of the combination, FIGS. 4B and 4C show a case in which the lateral control A and the conveying direction control A are combined so as to irradiate the entire area of a sheet, FIG. 5B shows a case in which the lateral control B and the conveying direction control A are combined so as to stop irradiating, laterally, a portion where an image is absent, and FIG. 5C shows a case in which the three kinds of control, i.e., the lateral control B, the conveying direction control A, and the conveying direction control C, are combined so as to effect irradiation of only portions with images.

A further description is made with reference to FIG. 5C. This Figure illustrates the control for irradiating only areas containing an image. In this case, as no image is contained in the area Ta on the left end of the areas Ta to Td constituting the sheet passing area T1, the LEDs 4 in the substrate 5 at the left end are kept turned off during the sheet P is passing thereunder, and the LEDs 4 in the second substrate 5 from the left end for irradiating the image G1 on the leading side in the conveying direction are turned on as soon as the leading end of the image G1 in the conveying direction reaches the irradiation area of the LEDs 4, and the LEDs 4 in the second substrate 5 from the left are turned off when the trailing end of the image G1 in the conveying direction passes through the irradiation area of the LEDs 4. Then, when the leading end of the image G2 in the conveying direction at the rear side in the conveying direction reaches an irradiation area of the LEDs 4, the LEDs 4 in the two, rightmost and second rightmost substrates 5 for irradiating the image G2 are turned on, and after the trailing end of the image G2 in the conveying direction has passed through the irradiation areas of the LEDs 4 in the two substrates 5, the LEDs 4 in the two substrates 5 are turned off. The control is then stopped until a next sheet P comes by.

As shown in FIG. 2, the control section S includes a timing adjusting part 12 for adjusting timing in a synchronous manner with a conveying speed of sheets P so as not to cause delay in the timing to turn on the LEDs 4 depending on the conveying speeds of the sheets P. Accordingly, a conveying speed detected at a conveying speed detecting part 13 that detects the conveying speeds of the sheets P is inputted to the timing adjusting part 12 for retrieval of a timing to turn on the LEDs 4 corresponding to the conveying speed detected, out of the pre-stored data, and the timing to turn on the LEDs 4 is adjusted based on the retrieved data.

In the foregoing embodiment, on/off-control of the LEDs 4 is performed through the control section S such that ultraviolet irradiation is effected on the entire area of a sheet, or alternatively, that ultraviolet irradiation is effected on the area of an image printed on the sheet; however, ultraviolet light from the LEDs 4 may be applied only to a portion of the image area, and ultraviolet light may be irradiated to any area insofar as the area is within a predetermined area of the sheet. Depending on the circumstances, a varnish for use in surface protection or gloss finishing of printed materials may be coated solely on a portion that does not contain an image, and on the varnish alone may be irradiated with ultraviolet light.

Figure 7:
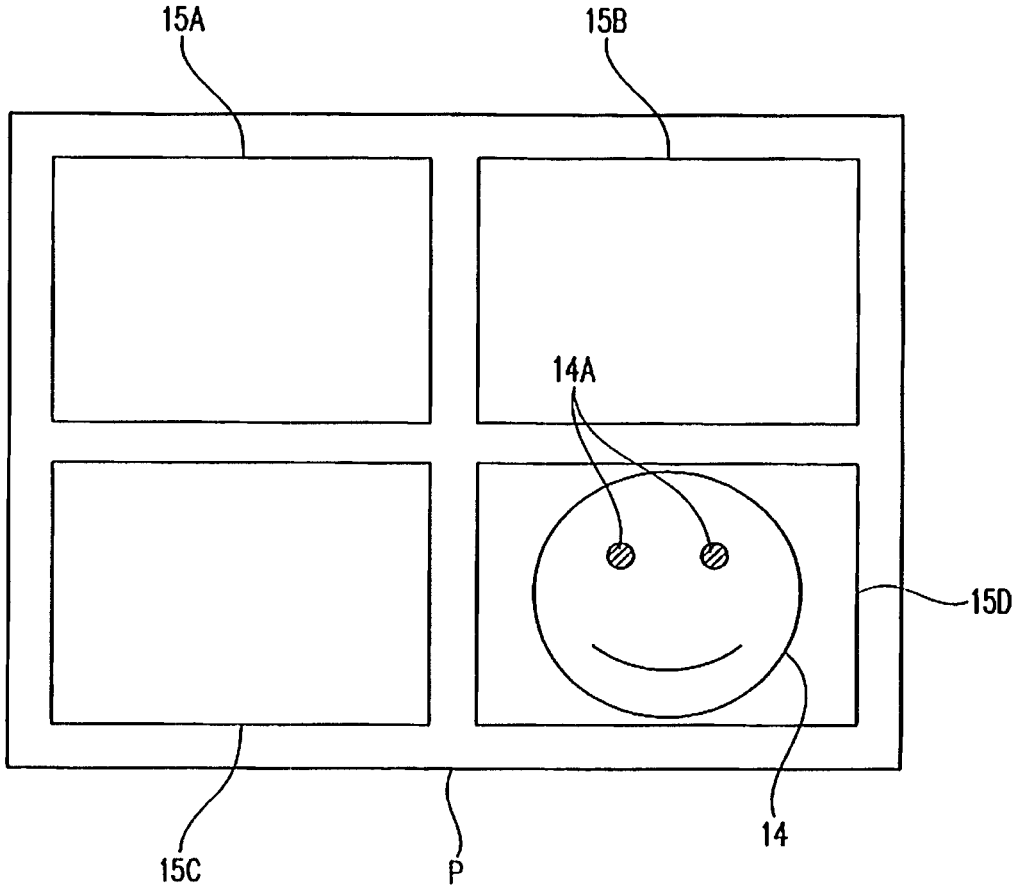
FIG. 7 is a plan view of another sheet of paper printed with an image.
Figure 8:
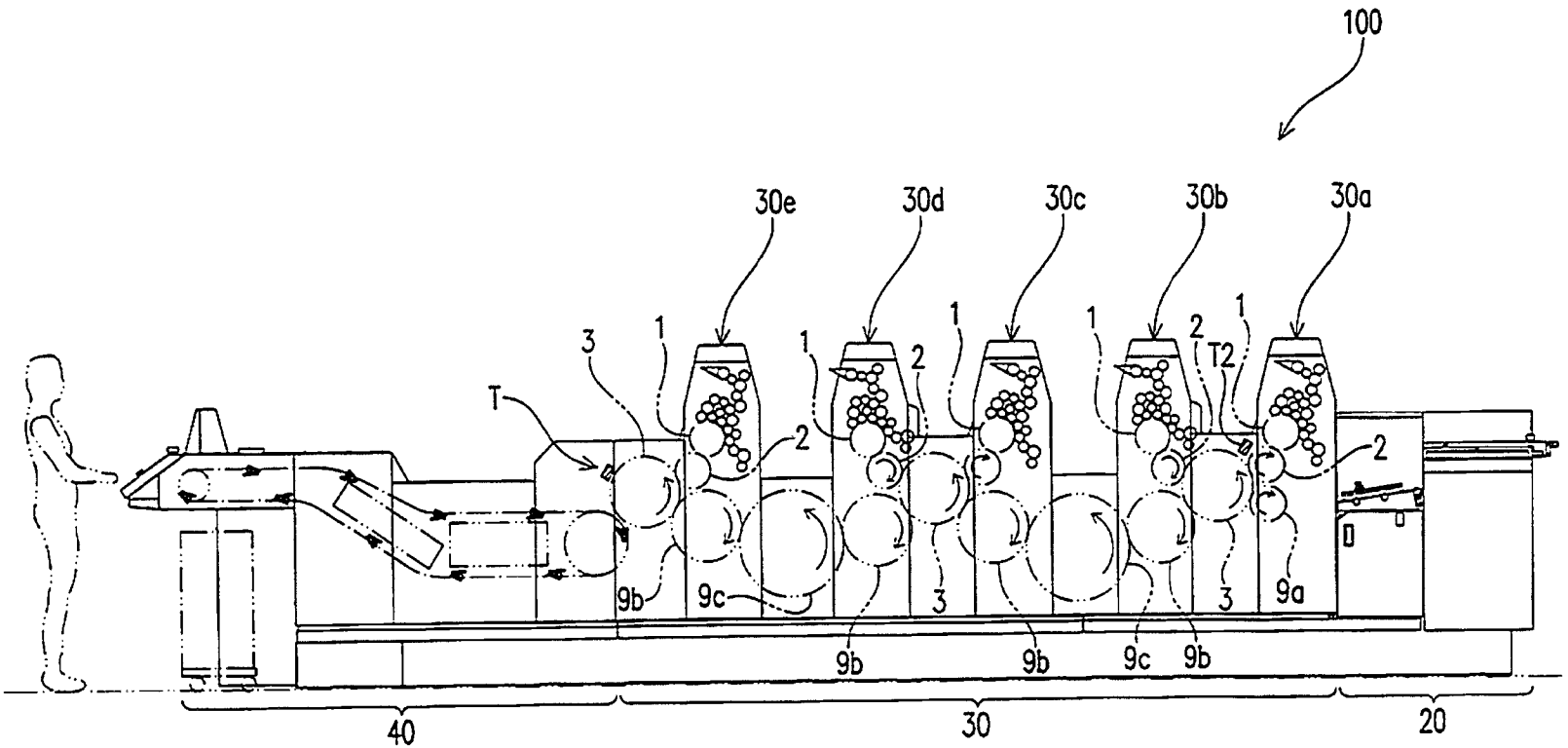
FIG. 8 is a side view of another printing press capable of performing characteristic printing.
Figure 9:
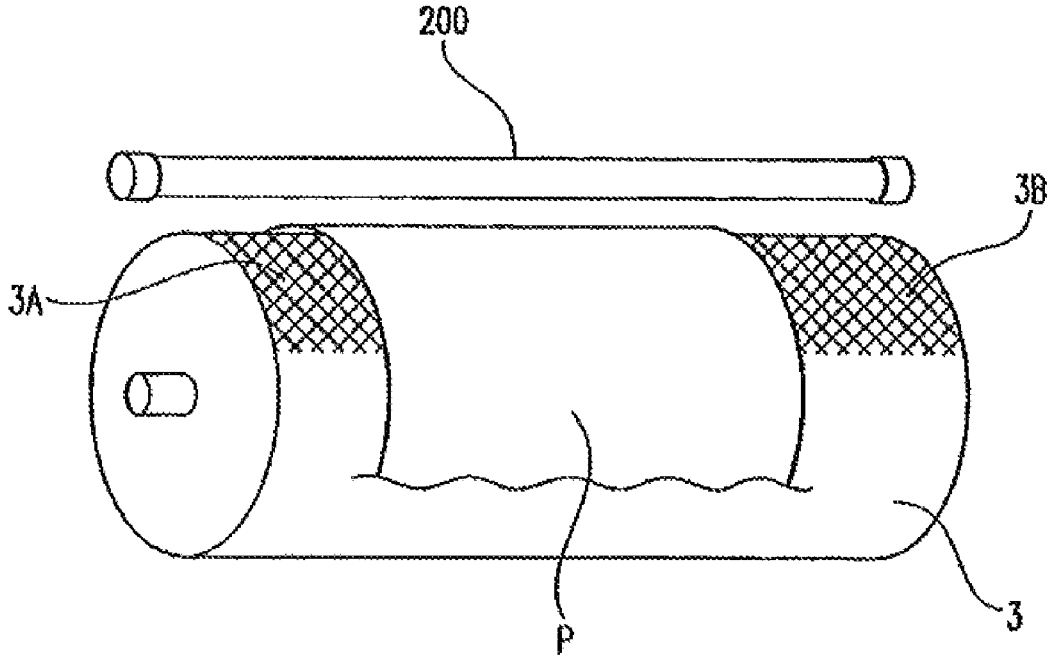
FIG. 9 (Prior Art)
FIG. 9 is a perspective view showing a conventional irradiation lamp.

FIG. 7 shows a sheet P in which a smiley image 14 is printed in an area 15D at the lower right of four divided areas 15A, 15B, 15C, and 15D of the sheet P. Where it is desired to print eye portions 14A of the smiley 14 in, e.g., silver to add a feature to the sheet, a printing press shown in FIG. 8 may be employed for such printing to obtain sheets with a high added value. The printing press of FIG. 8 is specifically provided with Et printing unit 30*a* that performs special color printing such as silver at the leading end in the sheet-conveying direction, by which printing unit 30*a* the eye portions 14A of the smiley 14 are printed in silver. An ultraviolet irradiator section T2 is disposed above an impression cylinder 3 so as to apply ultraviolet light solely to the eye portions 14A of the smiley 14 on the sheet P that has been printed and delivered thereto from the impression cylinder 3 to dry the eye portions 14A. Although having the same configuration as the ultraviolet irradiator section T, the ultraviolet irradiator section T2 may have a different configuration from that of the ultraviolet irradiator section T insofar as it is capable of irradiating ultraviolet light.

As described above, the eye portions 14A of the printed smiley 14 are irradiated with ultraviolet light and dried, which is followed by printing in basic colors (C, M, Y, and Bk) at four printing units 30*b*, 30*c*, 30*d*, and 30*e*. Then, as in FIG. 1, an ultraviolet irradiator section T dries the inks of the images formed on the sheet P. In the case of irradiating ultraviolet light solely to the eye portions 14A of the smiley 14 on the sheet P, the location of the sheet relative to the impression cylinder 3 and the locations of the images (the eye portions 14A of the smiley 14) printed on the sheet are found based on information from a detecting part (specifically, a rotary encoder) that detects the angle of rotation of the impression cylinder 3 to perform on/off-control of LEDs 4, in the same manner as described earlier. The location of the sheet relative to the impression cylinder 3 and the locations of the images relative to the sheet can be found according to data calculated based on pre-press data in the same manner as described above, which data is inputted to the control section S in advance and the location of the sheet relative to the impression cylinder 3 and the locations of the images relative to the sheet are found by the coincidence of the data with the detected information from the detecting part.

Figure 6A:
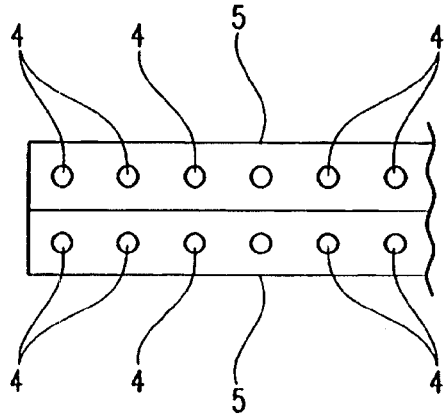
FIGS. 6A to 6C are front views showing arrangement of substrates in three different patterns.

The number and arrangement of the LEDs 4 shown in the foregoing embodiments are not limited to those illustrated. For instance, as shown in FIG. 6A, the substrates 5 may be arranged not only in the lateral direction of sheets but also in the conveying direction. The Figure shows a case in which the substrates 5 adjacent in the conveying direction are disposed uninterruptedly, but the substrates 5 may be spaced from each other. Where the LEDs 4 are thus arranged at positions overlapping with each other in the conveying direction, and if the LEDs 4 in the two rows in the lateral and conveying directions are all used, the total light quantity of all the one-rowed LEDs 4 are attained with all the two-rowed LEDs 4, so that the LEDs can be driven with some allowance in power, which is advantageous in terms of service life. In addition, only one of the two rows of the LEDs 4 may be used, and control may be performed such that a second row of the LEDs 4 is caused to turn on in place of a first row of the LEDs 4 in the event of going out of use of the first row of the LEDs 4 during use; in this manner, another advantage can be provided that the LEDs 4 which have gone out of use can be replaced after the operation of the printing press is stopped at the completion of the printing.

Figure 6B:
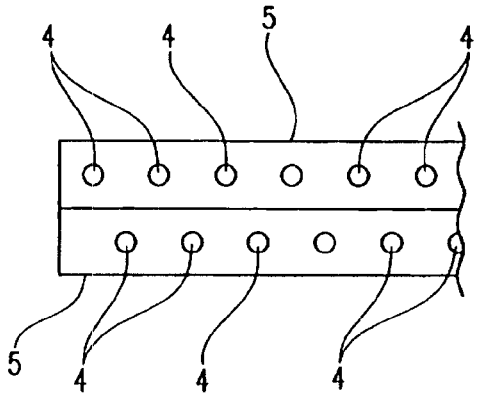
Figure 6C:
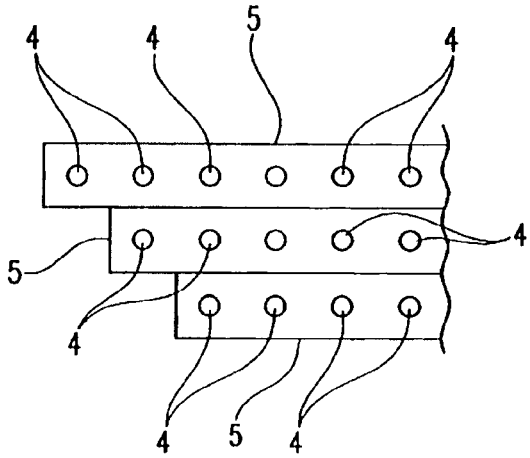

Also, as shown in FIG. 6C, three rows of the substrates 5 may be arranged in the lateral and conveying directions. In this case, only the locations of the endmost LEDs may be varied, whereby the LEDs, e.g., in a row corresponding to the width of a sheet can be on/off-controlled.

In addition, as shown in FIG. 6B, all the LEDs 4 may be adapted to turn on with the substrates 5 arranged in two rows in the conveying direction and the LEDs 4 adjacent in the conveying direction staggered; in this manner, it is possible to reliably prevent occurrence of portions where the hardness of inks is not good due to spotty irradiation of the LEDs 4.

Further, while the control configuration can be advantageously simplified by fitting the plurality of LEDs 4 in the substrates 5 and performing on/off-control of the LEDs 4 on a substrate-by-substrate basis, the on/off-control may also be performed individually for each of the LEDs 4. In addition to using the LEDs 4 of a round type, it is possible to use a light emitting diode module unit including a plurality of light emitting diode chips.

Moreover, although an off of the LEDs 4 generally indicates the turned-off state, the term may also encompass a state in which the output level is lowered to such a degree that the inks are unable to be cured, and the LEDs 4 are "turned on" by raising the output from the low output level to a level at which the inks become curable.

Furthermore, while printing presses that create images with five color inks are shown above, the images may be created in any number of colors. Although in the foregoing embodiments, only inks are shown as the paints of the present invention, the paints also include varnishes for use in surface protection and gloss finishing of the ink-printed materials.

This specification is by no means intended to restrict the present invention to the preferred embodiments set forth therein. Various modifications to the printing method for printing and the printing press, as described herein, may be made by those skilled in the art without departing from the spirit and scope of the present invention as defined in the appended claims.

What is claimed is:

1. A printing method for a printing press comprising:

printing an image on a sheet of paper fed using an ultraviolet curable paint; and irradiating the ultraviolet curable paint on the printed sheet fed with ultraviolet light from a plurality of light emitting diodes disposed at predetermined intervals across a lateral direction of the sheet, thereby curing the ultraviolet curable paint, wherein sheet passing areas which through the sheet passes are divided into a plurality of areas in the lateral direction, determination is made based on pre-press data prepared during a process of creating a plate as to whether or not each divided area contains an image, and the light emitting diodes are controlled such that a light emitting diode for irradiating the area containing the image is turned on, and that a light emitting diode for irradiating the area not containing the image is turned off.

2. The method according to claim 1, the printing press including a plurality of substrates disposed in the lateral direction of the sheet so as to correspond to the plurality of divided areas, each of the substrates including a plurality of light emitting diodes, wherein the light emitting diodes are on/off-controlled on a substrate-by-substrate basis.

3. The method according to claim 1, wherein the light emitting diodes are turned on as soon as a leading end of the sheet in a conveying direction locates at an irradiation area of the light emitting diodes, and the turned-on light emitting diodes are turned off when a trailing end of the sheet in the conveying direction is out of the irradiation area of the light emitting diodes.

4. The method according to claim 1, wherein the light emitting diodes are turned on as soon as a leading end of an image printed on the sheet in a conveying direction locates at an irradiation area of the light emitting diodes, and the turned-on light emitting diodes are turned off when a trailing end of the image in the conveying direction is out of the irradiation area of the light emitting diodes.

5. The method according to claim 4, wherein in printing on the sheet a plurality of images with a space interposed therebetween in the conveying direction, determination is made as to whether or not the space is equal to or larger than a predetermined distance, and when the space is determined as being equal to or larger than the predetermined distance, the light emitting diodes are turned off when a trailing end of an image on an upstream side in the conveying direction passes through an irradiation area of the light emitting diodes, and the turned-off light emitting diodes arc switched on as soon as a leading end of an image on a downstream side in the conveying direction locates at the irradiation area of the light emitting diodes.

6. A method comprising on/off-controlling light emitting diodes according to claim 1, wherein the light emitting diodes are turned on as soon as a leading end of the sheet or an image printed on the sheet in a conveying direction locates at an irradiation area of the light emitting diodes, and the turned-on light emitting diodes are switched off when a trailing end of the sheet or the image printed on the sheet in the conveying direction is out of the irradiation area of the light emitting diodes.

7. A printing press comprising:

a printer section for printing an image on a sheet of paper fed using an ultraviolet curable paint; and an ultraviolet irradiator section for curing the ultraviolet curable paint on the printed sheet fed, wherein the ultraviolet irradiator section includes a plurality of light emitting diodes arranged at predetermined intervals across a lateral direction of the sheet, and sheet passing areas which through the sheet passes are divided into a plurality of areas in the lateral direction, determination is made based on pre-press data prepared during a process of creating a plate as to whether or not each divided area contains an image, and the light emitting diodes are controlled such that a light emitting diode for irradiating the area containing the image is turned on, and that a light emitting diode for irradiating the area not containing the image is turned off.

8. The printing press according to claim 7, including a plurality of substrates disposed in the lateral direction of the sheet so as to correspond to the plurality of divided areas, each of the substrates including a plurality of light emitting diodes, wherein the light emitting diodes are on/off-controlled on a substrate-by-substrate basis.

* * * * *